US005707105A

United States Patent [19]

Liu

[11] Patent Number: 5,707,105

[45] Date of Patent: Jan. 13, 1998

[54] SAFETY LOCK FOR A FOLDING CHAIR

[76] Inventor: Lausan Chung Hsin Liu, No. 243, Chien-Kuo Rd., Hsin-Tien City, Taipei Hsien, Taiwan

[21] Appl. No.: 760,227

[22] Filed: Dec. 4, 1996

[51] Int. Cl.[6] ..... A47C 4/00

[52] U.S. Cl. ..... 297/40; 297/16.1

[58] Field of Search ..... 297/39, 40, 31, 297/21, 16.1, 463.1, 378.12, 378.1

[56] References Cited

U.S. PATENT DOCUMENTS

| | | | |
|---|---|---|---|
| 3,319,997 | 5/1967 | Clement | 297/39 X |
| 4,580,833 | 4/1986 | Waples | 297/39 |
| 4,693,510 | 9/1987 | Marchesini | 297/39 |
| 4,963,762 | 10/1990 | Brooks | 297/39 X |
| 5,054,848 | 10/1991 | Liu | 297/16.1 X |
| 5,529,270 | 6/1996 | Liu | 297/31 X |

FOREIGN PATENT DOCUMENTS

| | | | |
|---|---|---|---|
| 179409 | 4/1986 | European Pat. Off. | 297/16.1 |
| 589647 | 3/1959 | Italy | 297/31 |
| 2132082 | 7/1984 | United Kingdom | 297/16.1 |

*Primary Examiner*—Milton Nelson, Jr.
*Attorney, Agent, or Firm*—Bacon & Thomas

[57] ABSTRACT

A safety lock is pivotally secured to a back frame and a stand frame of a folding chair by a pivot pin to secure said folding chair in an extended position, the safety lock including a metal hook having a retaining notch adapted for hooking on a headed locating pin, and a rubber cap enclosing the hook and having a retaining notch adapted for hooking on the headed locating pin and an inside recess adapted for receiving the head of the headed locating pin.

4 Claims, 5 Drawing Sheets

SAFETY LOCK FOR A FOLDING CHAIR

BACKGROUND OF THE INVENTION

The present invention relates to folding chairs, and more specifically to a safety lock for a folding chair which firmly retains the folding chair in the operative position when the folding chair is extended out.

Conventional folding chairs are commonly made from wooden material. Because these wooden folding chairs are heavy, they have been gradually abandoned. Nowadays, most folding chairs are made from metal. These metal folding chairs are commonly comprised of a folding frame structure comprised of a plurality of rod members pivotably connected together by screws and nuts, and a cloth seat and a cloth back respectively fastened to the folding frame structure. These conventional folding chairs are still not satisfactory in function. When the user sits on the chair, the back frame, the seat frame, and the stand frame tend to vibrate relative to one another. Therefore, the folding frame structure may collapse suddenly when in use, causing the user to be injured.

SUMMARY OF THE INVENTION

The present invention provides a safety lock which eliminates the aforesaid problems. It is one object of the present invention to provide a safety lock for a folding chair which firmly retains the folding chair in the operative position when the folding chair is extended out. It is another object of the present invention to provide a safety lock for a folding chair which prolongs the service life of the folding chair. It is still another object of the present invention to provide a safety lock for a folding chair which is safe in use. According to the present invention, the safety lock comprises a metal hook supported for rotation about a pivot pin, which connects the back frame and stand frame of the folding chair together, and the hook having a retaining notch adapted for hooking on a headed locating pin at one side of the seat frame of the folding chair to hold the folding chair in the operative position. A rubber cap encloses the hook and also rotates with it about the pivot pin, the cap having a retaining notch adapted for hooking on the headed locating pin and an inside recess adapted for receiving the head of the headed locating pin.

DETAILED DESCRIPTION OF THE PREFERRED EMBODIMENT

Figure 1:
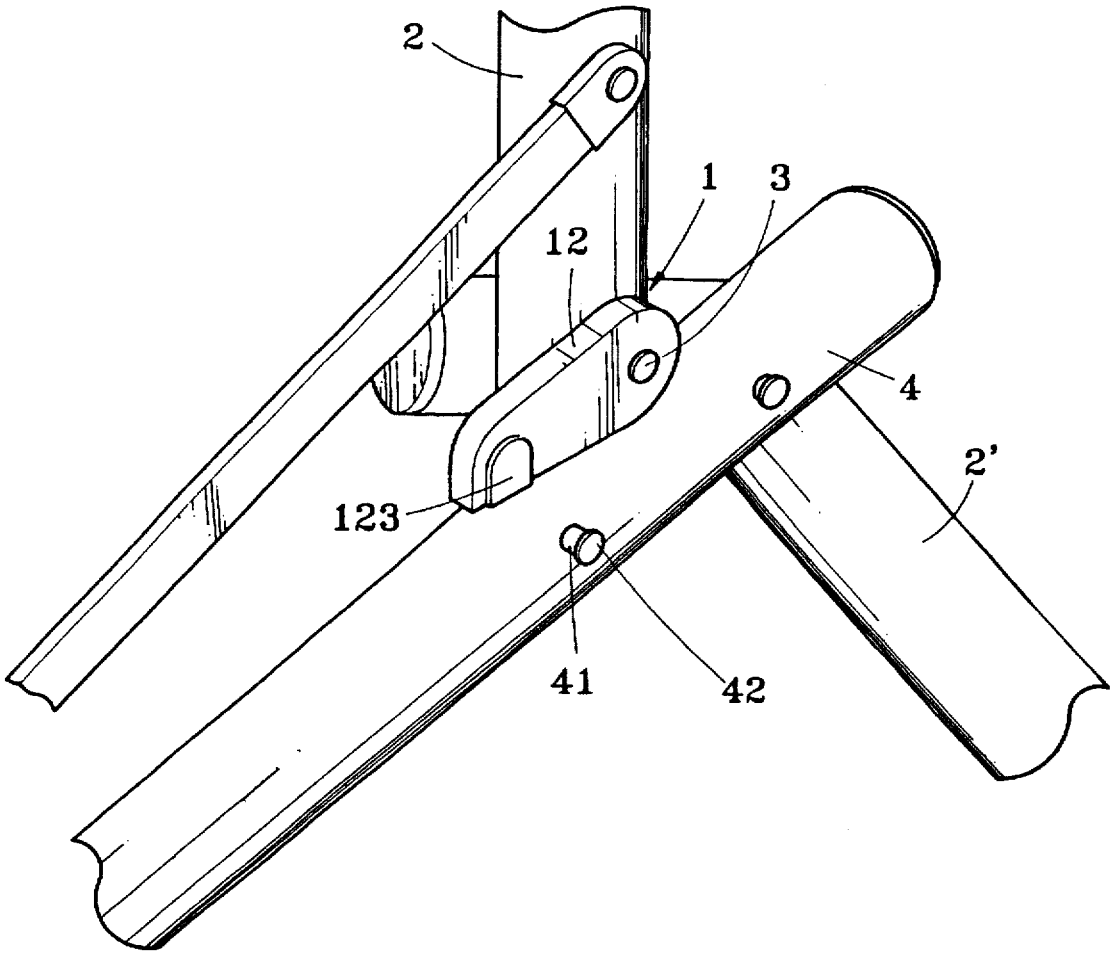
FIG. 1 is perspective view of a safety lock according to the present invention.
Figure 2:
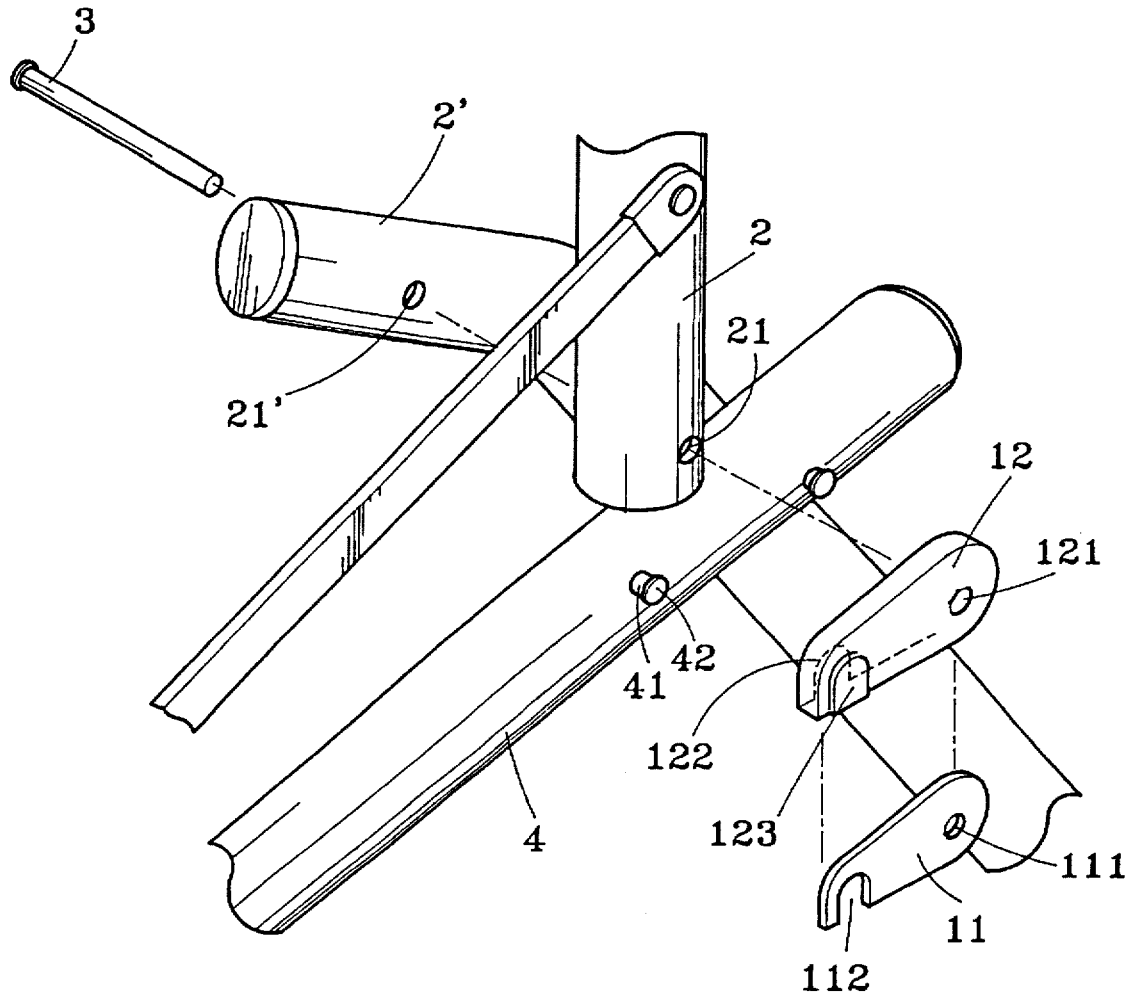
FIG. 2 is an exploded view of FIG. 1.

Referring to FIGS. 1 and 2, a safety lock 1 in accordance with the present invention is generally comprised of a hook 11, and a cap 12 which encloses the hook 11. The hook 11 and the cap 12 each have a respective pivot hole 111, 121 at one end respectively pivotably connected to a pivot hole 21 at one end of the back frame 2 of a folding chair (not shown) and a pivot hole 21' at one end of a stand frame 2' of the folding chair by a pivot pin 3, and a respective arched retaining notch 112, 122 at an opposite end adapted for hooking on a locating pin 41 at one side of the seat frame 4 of the folding chair. The cap 12 has an inside recess 123 adapted for receiving the head 42 of the locating pin 41 when the retaining notch 122 is forced into engagement with the locating pin 41.

Figure 3:
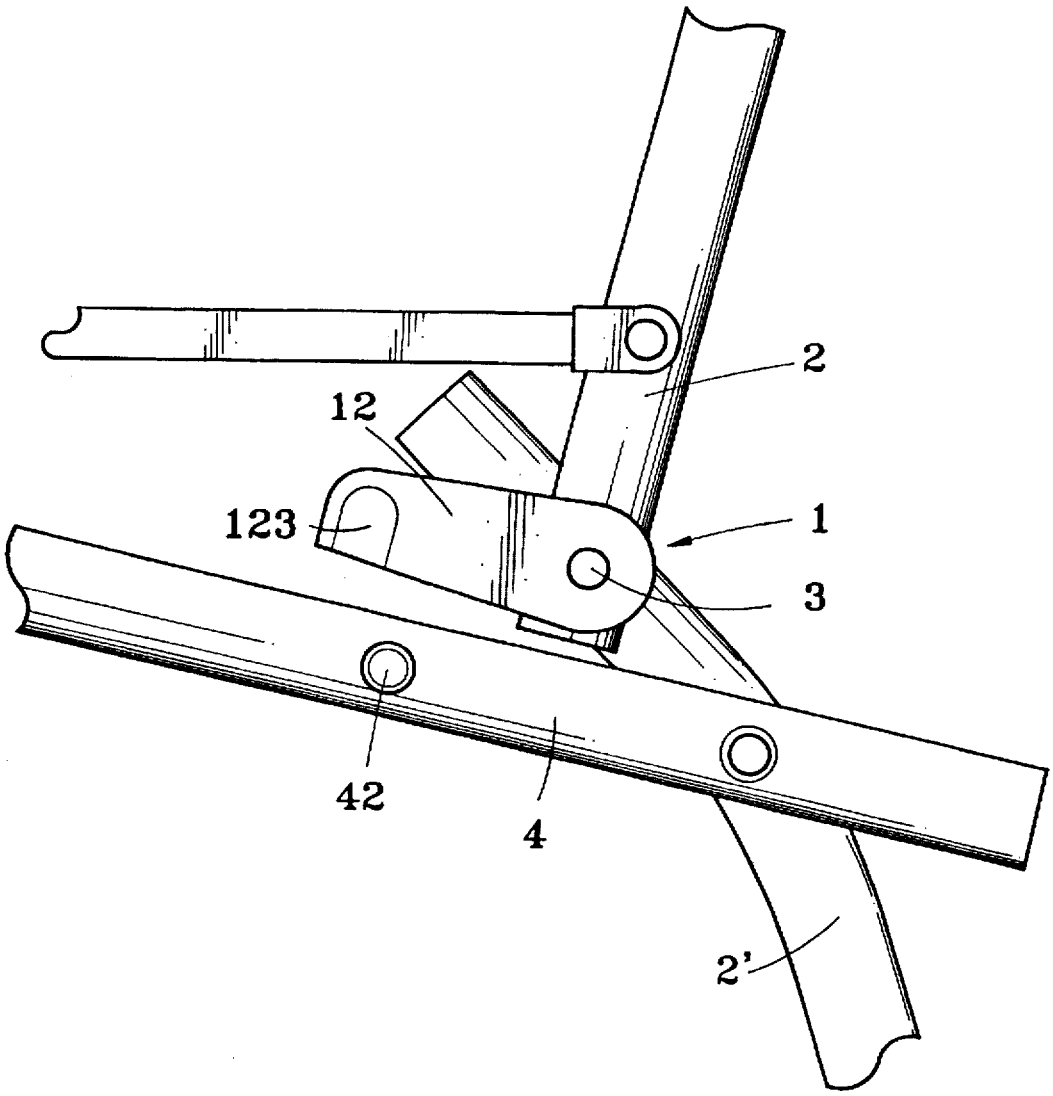
FIG. 3 is a side view of FIG. 1.
Figure 4:
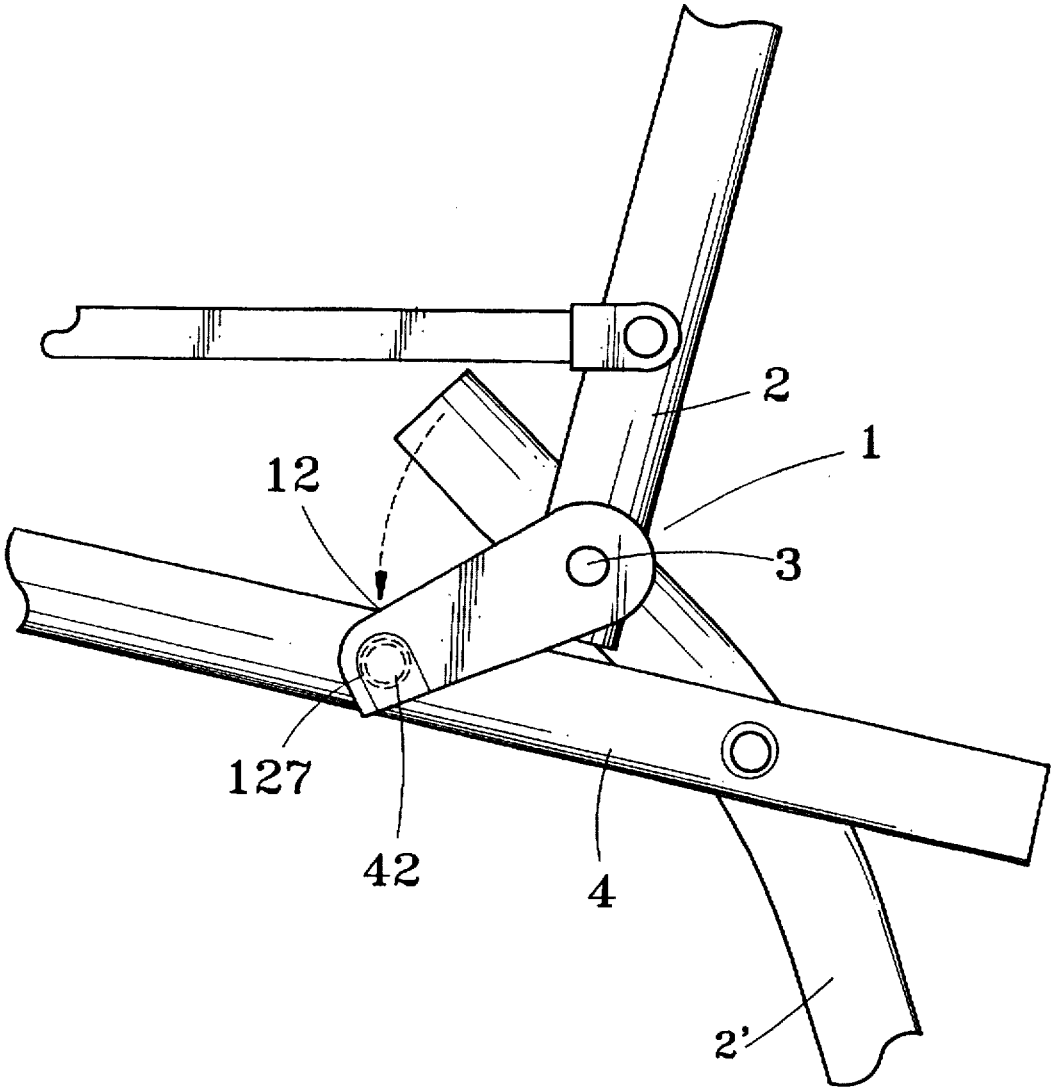
FIG. 4 is similar to FIG. 3 but showing the safety lock in a locked position.

Referring to FIGS. 3 and 4, when the folding chair is extended out, the back frame 2 is retained in a position approximately perpendicular to the seat frame 4, and the safety lock 1 rotates about the pivot pin 3 to force the retaining notch 112 of the hook 11 and the retaining notch 122 of the cap 12 into engagement with the locating pin 41 of the seat frame 4, permitting the head 42 of the locating pin 41 to be received in the inside recess 123 of the cap 12, and therefore the back frame 2 and the seat frame 4 are firmly retained in the extended position, and prohibited from rotating relative to each other. The hook 11 of the safety lock 1 is preferably made from metal, so that the safety lock 1 can bear pressure transmitted through the seat frame 4 and the back frame 2. The cap 12 is preferably molded from rubber. Because the hook 11 is enclosed within the cap 12, the user will not be injured by the hook 11 when operating the safety lock 1.

Figure 5B:
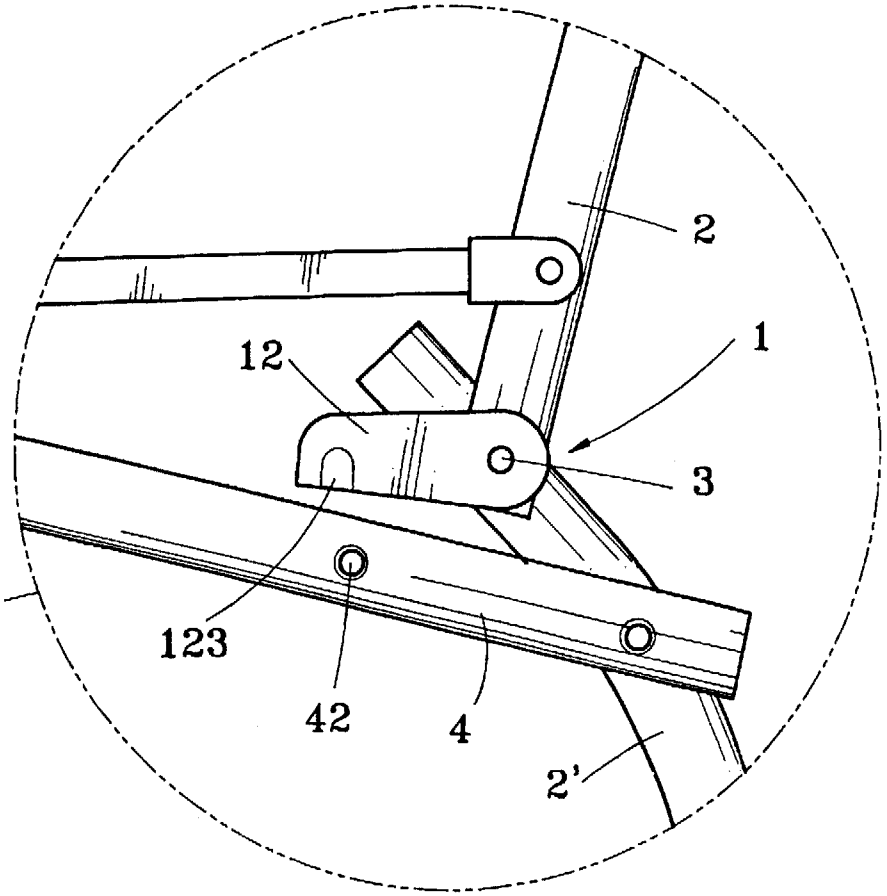
FIG. 5B is an enlarged view of the circled portion of FIG. 5A.
Figure 5A:
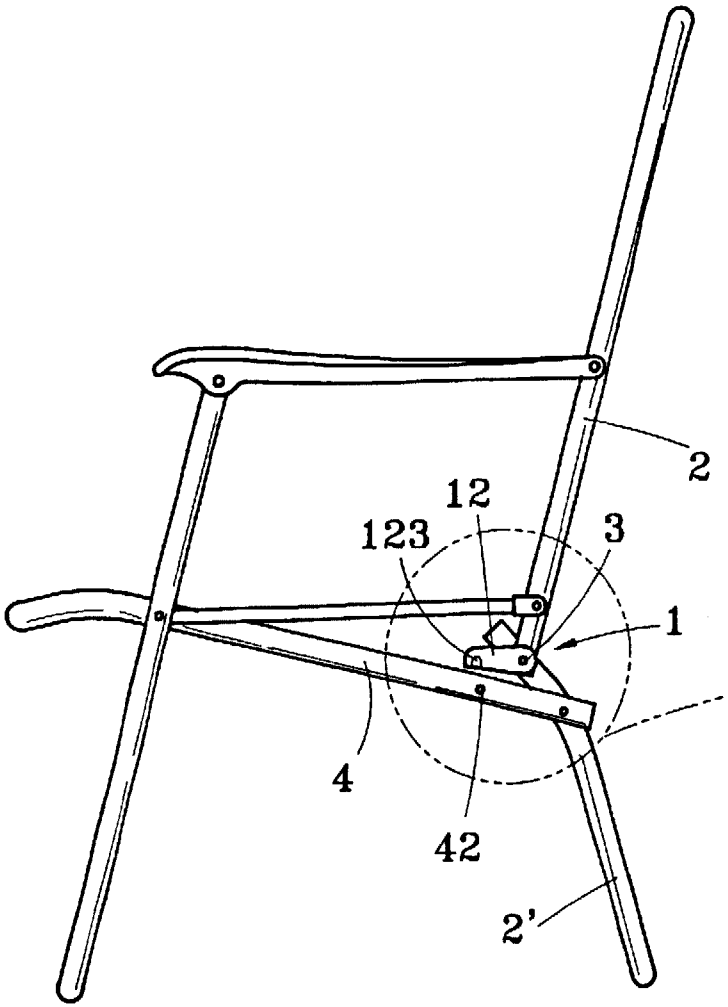
FIG. 5A is a side view of the present invention, showing the safety lock installed in a folding chair.

FIGS. 5A and 5B show the present invention installed in a folding chair, and adapted for securing the folding chair in the extended position.

I claim:

1. A safety lock pivotally secured to a back frame and a stand frame of a folding chair by a pivot pin and adapted for hooking on a headed locating pin at one side of a seat frame of said folding chair to secure said folding chair in an extended position, the safety lock comprising a hook having a fixed end supported for rotation about said pivot pin and a free end provided with a retaining notch adapted for hooking on said headed locating pin, and a cap enclosing said hook, said cap having a fixed end supported for rotation about said pivot pin, and a free end provided with a retaining notch adapted for hooking on said headed locating pin and an inside recess adapted for receiving the head of said headed locating pin.

2. The safety lock of claim 1 wherein said hook is made from metal.

3. The safety lock of claim 1 wherein the retaining notch of said hook and the retaining notch of said cap have an arched shape.

4. The safety lock of claim 1 wherein said cap is molded from rubber.

* * * * *